US008390563B2

(12) United States Patent
Nonaka et al.

(10) Patent No.: US 8,390,563 B2
(45) Date of Patent: Mar. 5, 2013

(54) IMAGE DISPLAY APPARATUS

(75) Inventors: Ryosuke Nonaka, Kawasaki (JP); Masahiro Baba, Yokohama (JP); Yuma Sano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 313 days.

(21) Appl. No.: 12/563,507

(22) Filed: Sep. 21, 2009

(65) Prior Publication Data

US 2010/0238201 A1 Sep. 23, 2010

(30) Foreign Application Priority Data

Mar. 19, 2009 (JP) ..... 2009-068425

(51) Int. Cl.
*G09G 3/36* (2006.01)
*G09G 5/10* (2006.01)

(52) U.S. Cl. ..... 345/102; 345/690

(58) Field of Classification Search ..... None
See application file for complete search history.

(56) References Cited

U.S. PATENT DOCUMENTS

| | | | | |
|---|---|---|---|---|
| 2008/0111784 | A1 | 5/2008 | Tanaka et al. | |
| 2008/0117160 | A1 * | 5/2008 | Oka et al. | 345/102 |
| 2009/0115720 | A1 * | 5/2009 | Inada et al. | 345/102 |

FOREIGN PATENT DOCUMENTS

| | | |
|---|---|---|
| JP | 2002-099250 | 4/2002 |
| JP | 2005-309338 | 11/2005 |
| JP | 2007-025187 | 2/2007 |
| JP | 2007-163647 | 6/2007 |
| JP | 2008-076755 | 4/2008 |
| WO | 2005085007 A1 | 9/2005 |

OTHER PUBLICATIONS

Japanese Office Action for Application No. 2009-068425 mailed on Mar. 29, 2011.

* cited by examiner

*Primary Examiner* — Andrew L Sniezek
(74) *Attorney, Agent, or Firm* — Turocy & Watson, LLP

(57) ABSTRACT

An image display apparatus for displaying images based on signals of an input image is provided. A backlight emits light. A liquid crystal panel modulates light emitted from the backlight. A emission intensity calculating unit calculates an emission intensity of the backlight such that a center value of a lightness range displayable on the panel defined depending on the emission intensity of the backlight substantially agrees with a center value between maximum and minimum values of lightness of each signal of the input image. A backlight controlling unit controls light emission of the backlight such that the light is emitted with the emission intensity. A signal correcting unit corrects each signal of the input image in accordance with the emission intensity. A liquid crystal controlling unit controls modulation of the liquid crystal panel based upon the corrected signals.

7 Claims, 17 Drawing Sheets

IMAGE DISPLAY APPARATUS

CROSS REFERENCE TO RELATED APPLICATIONS

This application is based upon and claims the benefit of priority from the prior Japanese Patent Application No. 2009-68425, filed on Mar. 19, 2009, the entire contents of which are incorporated herein by reference.

BACKGROUND OF THE INVENTION

1. Field of the Invention

The present invention relates to an image display apparatus.

2. Related Art

Conventionally, in a liquid crystal display apparatus, a luminance of a backlight has been controlled for purposes of expanding a display dynamic range, lowering consumption power, and the like.

For example, in JP-A 2005-309338 (Kokai), a luminance of a backlight is controlled so that the maximum luminance in the input image can be displayed by calculating a modulation ratio of the luminance of the backlight from the maximum luminance value in an input image.

However, when the control of the modulation ratio of the luminance is performed based on the maximum luminance value in the image, the following problem occurs. That is, in case that a range of the luminance in the input image is large, a bright portion of the input image is preferentially displayed and a dark portion of the input image is not sufficiently displayed, and consequently, deterioration of image quality is stood out such that black become like white.

SUMMARY OF THE INVENTION

According to an aspect of the present invention, there is provided with an image display apparatus for displaying images based on an input image. The image display apparatus includes a backlight, the liquid crystal panel, the emission intensity calculating unit, the backlight controlling unit, the signal correcting unit and the liquid crystal controlling unit. The backlight emits light. The liquid crystal panel modulates light emitted from the backlight. A emission intensity calculating unit calculates an emission intensity of the backlight such that a center value of a lightness range displayable on the panel defined depending on the emission intensity of the backlight substantially agrees with a center value between maximum and minimum values of lightness of each signal of the input image. A backlight controlling unit controls light emission of the backlight such that the light is emitted with the emission intensity. A signal correcting unit corrects each signal of the input image in accordance with the emission intensity. A liquid crystal controlling unit controls modulation of the liquid crystal panel based upon the corrected signals.

DETAILED DESCRIPTION OF THE INVENTION

First Embodiment

An image display apparatus according to a first embodiment of the present invention is described with reference to drawings.

Configuration of Image Display Apparatus

Figure 1:
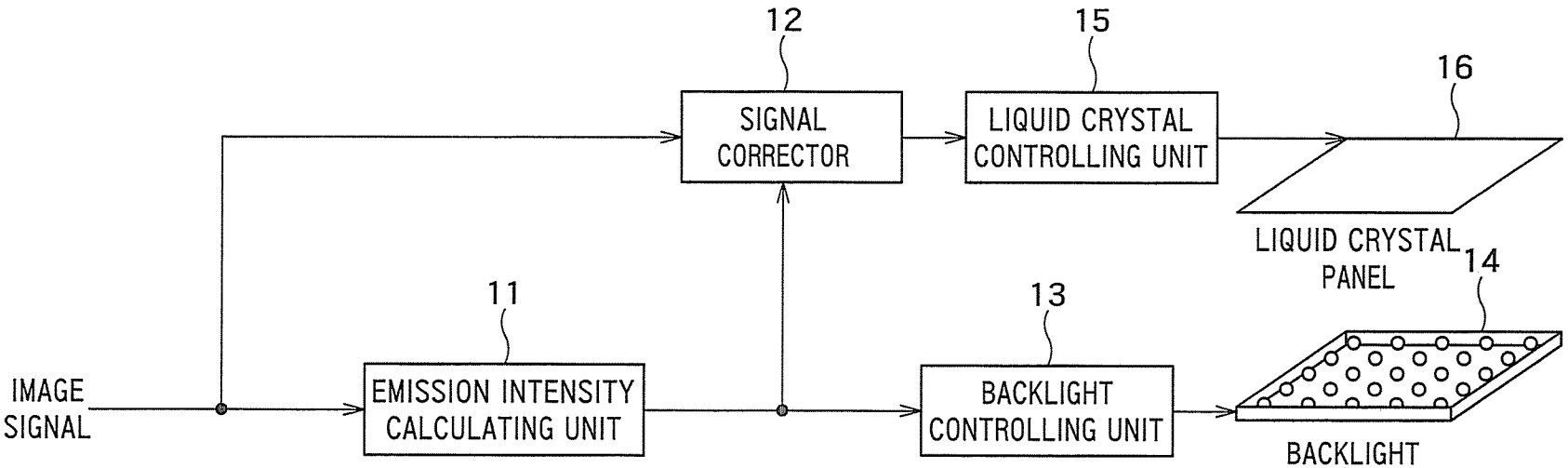
FIG. 1 is a view showing a constitution example of an image display apparatus according to a first embodiment.

FIG. 1 shows a configuration of the image display apparatus according to the present embodiment. An image display apparatus according to the present embodiment includes an emission intensity calculating unit 11, a signal corrector 12, a backlight controlling unit 13, a backlight 14, a liquid crystal controlling unit 15, and a liquid crystal panel 16 where a plurality of pixels are arrayed in matrix form.

The emission intensity calculating unit 11 calculates a luminance modulation ratio (emission intensity) of the backlight 14 which is suitable for display based upon an image signal of one frame. The signal corrector 12 corrects a luminance (light transmittance) of each pixel in the image signal based upon the calculated luminance modulation ratio of the backlight 14, and outputs the corrected image signal to the liquid crystal controlling unit 15. The backlight controlling unit 13 controls lighting (light emitting) of the backlight 14 based upon the luminance modulation ratio calculated by the emission intensity calculating unit 11. The backlight 14 emits light under control of the backlight controlling unit 13. The liquid crystal controlling unit 15 controls the liquid crystal panel 16 based upon the image signal corrected by the signal corrector 12. The liquid crystal panel 16 changes a transmittance amount of light from the backlight 14 under control of the liquid crystal controlling unit 15. That is, the liquid crystal panel 16 modulates the light emitted from the backlight 14 to display an image.

In the following, the configuration and operation of each unit will be described in detail.

Backlight 14

Figure 2:
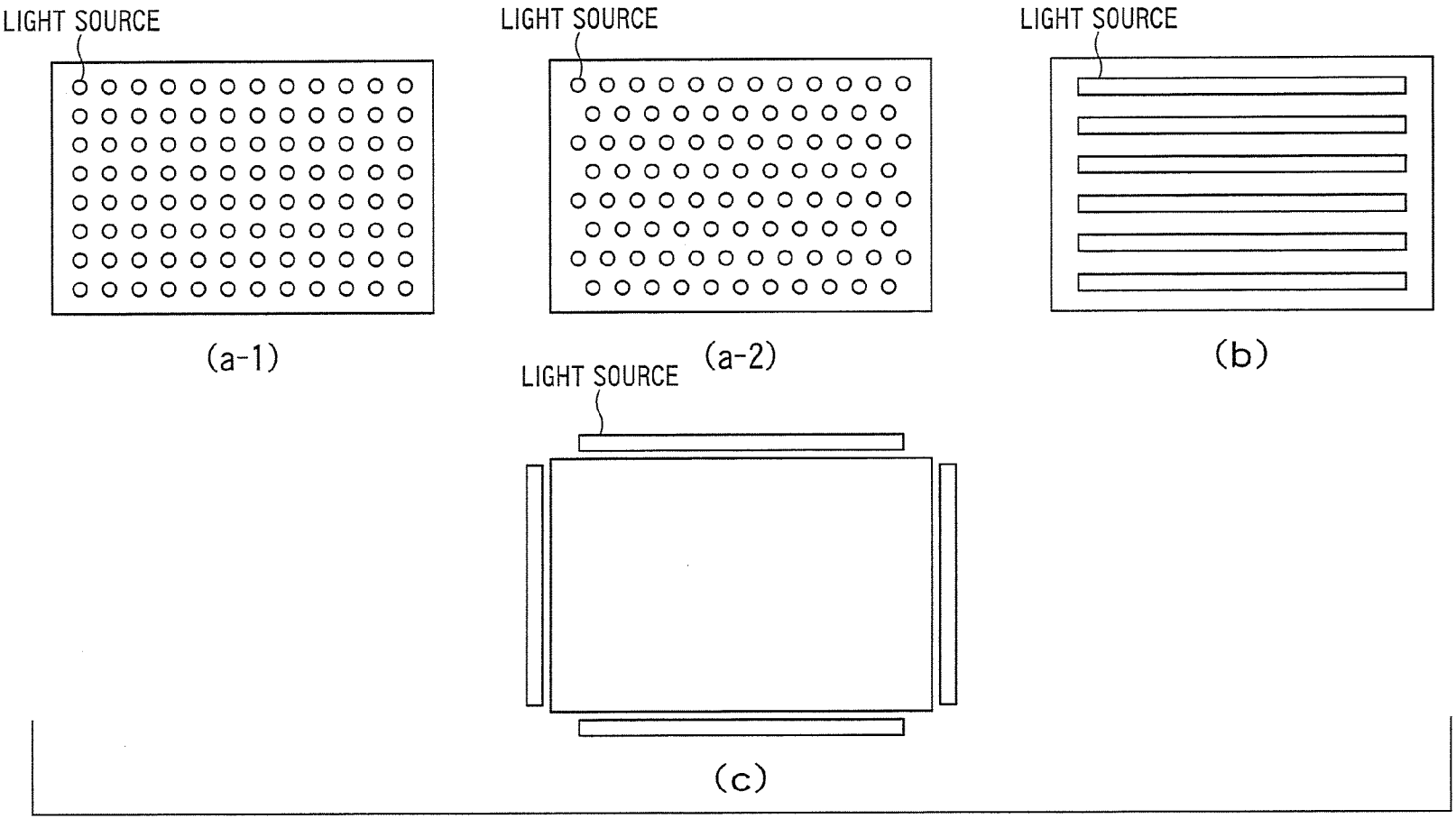
FIG. 2 is a view showing a constitution example of a backlight according to the first embodiment.

The backlight 14 is lighted strongly or weakly by control of the backlight controlling unit 13, and irradiates the liquid crystal panel 16 from the back surface thereof. FIG. 2(*a*-1), (*a*-2), (*b*), and (*c*) show a configuration of one specific example of the backlight 14. As shown in FIG. 2(*a*-1), (*a*-2), (*b*), and (*c*), the backlight 14 has at least not less than one light sources. The arrangement of the light sources may be a direct type as shown in FIG. 2(*a*-1), (*a*-2) and (*b*), where the light sources are arranged on the back surface of the liquid crystal panel 16, or may be an edge light type as shown in FIG. 2(*c*), where the light sources are arranged on the side surfaces of the liquid crystal panel 16 and light is led to the back surface of the liquid crystal panel 16 by a light guiding board or a reflector, not shown, to irradiate the liquid crystal panel 16 from the back surface thereof. An LED, a cold-cathode tube, a hot-cathode tube, and the like are suitable for the light source. The LED is particularly preferably used as the light-emitting element since it has a large width between the maximum light emittable luminance and the minimum light emittable luminance and hence its light emission can be controlled in a high dynamic range. The emission intensity (emission luminance) and the light-emission timing of the backlight 14 are controllable by the backlight controlling unit 13.

Backlight Controlling Unit 13

Figure 3A:
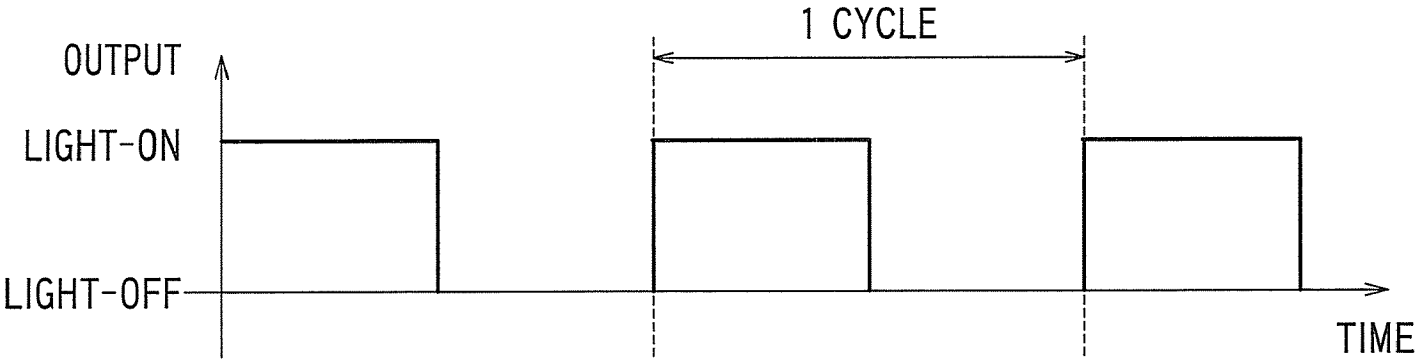
FIGS. 3A and 3B are views explaining a lighting scheme of the backlight.
Figure 3B:
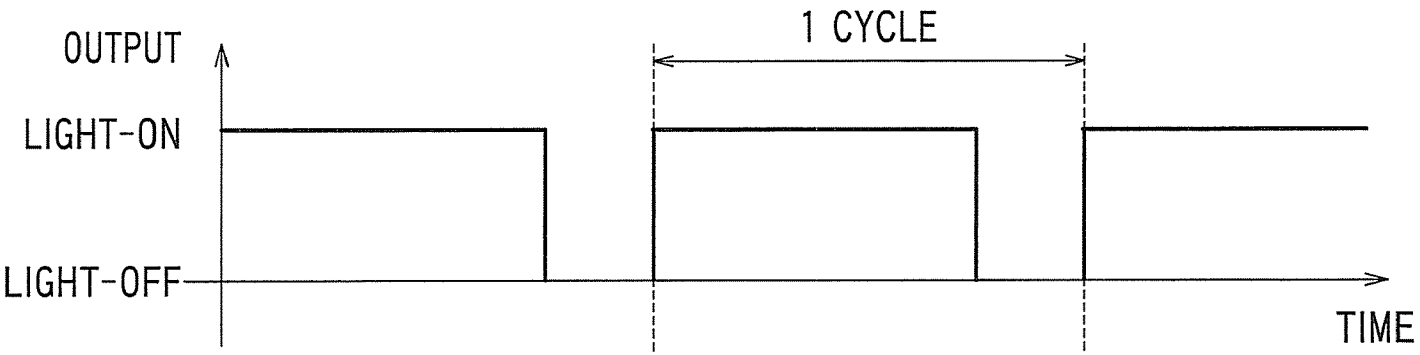

The backlight controlling unit 13 controls lighting of the backlight 14 based upon the luminance modulation ratio of the backlight 14 which was calculated by the emission intensity calculating unit 11. The luminance modulation ratio is a value showing a ratio of the emission luminance with which the backlight 14 is to be lighted with respect to the emission luminance of the backlight 14 with which the backlight 14 is most brightly lighted. FIGS. 3A and 3B show examples of output of the backlight controlling unit 13 in the case of controlling the backlight 14 by use of a PWM (Pulse Width Modulation) scheme. FIGS. 3A and 3B show the respective output examples in the case of outputting a PWM control signal corresponding to a luminance modulation ratio of 0.5 and a luminance modulation ratio of 0.75 with respect to the emission luminance as when the backlight is lightened full-time. In the PWM system, the luminance of the backlight 14 is controlled by changing a rate of a lightening period during one cycle. In this manner, the backlight controlling unit 13 controls the emission intensity (emission luminance) and the light-emission timing of the backlight 14.

Emission Intensity Calculating Unit 11

Figure 4:
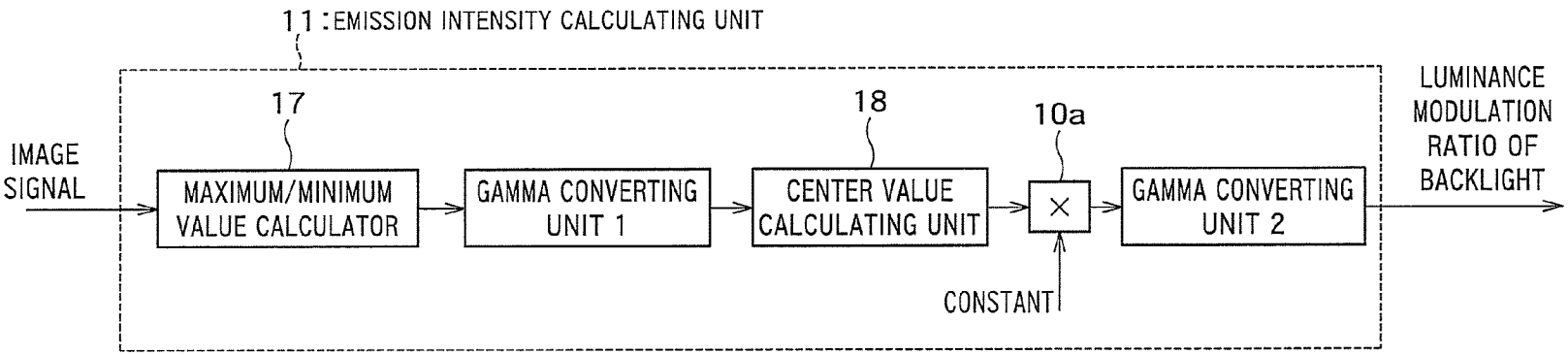
FIG. 4 is a view showing a constitution example of an emission intensity calculating unit according to the first embodiment.

The emission intensity calculating unit 11 calculates based on an image signal a luminance modulation ratio of the backlight 14 which is suitable for display. FIG. 4 shows a configuration of one specific example of this emission intensity calculating unit 11. The emission intensity calculating unit 11 includes a maximum/minimum value calculator 17, a gamma converting unit 1, a center value calculating unit 18, a multiplier 10*a* and a gamma converting unit 2. A maximum/minimum value calculator 17 and a gamma converting unit 1 can make up an acquiring unit.

The maximum/minimum value calculator 17 calculates (finds) a maximum value and a minimum value from signal values corresponding to plural pixels. A spatial range of signal values from which the maximum and minimum values are calculated may be the whole of the liquid crystal panel 16 or a smaller range than the whole.

The gamma converting unit 1 converts the inputted maximum and minimum values into a maximum lightness "$L^*_{MAX}$" and a minimum lightness "$L^*_{MIN}$" by gamma conversion. When the input image signal is a signal in a range of [0, 255], this conversion is expressed for example by:

$$L^*_{MAX}=(1-\alpha_1)(S_{MAX}/255)^{\gamma_1}+\alpha_1 \quad \text{[Formula 1]}$$

$$L^*_{MIN}=(1-\alpha_1)(S_{MIN}/255)^{\gamma_1}+\alpha_1 \quad \text{[Formula 2]}$$

Here, "$S_{MAX}$" and "$S_{MIN}$" are the maximum/minimum values of signal values calculated in the maximum/minimum value calculator 17. "$\gamma_1$" and "$\alpha_1$" may be arbitral actual numbers, but in the case of performing the conversion in the most simplified manner, "$\alpha_1=0.0$" and "$\gamma_1=2.2/3.0$" are typically used. By performing the gamma conversion with "$\alpha_1=0.0$" and "$\gamma_1=2.2/3.0$", a signal value is converted to "lightness" representing criterion of brightness which is proportional to perception of human. The conversion may be directly calculated by use of a multiplier or the like, or may be calculated by use of a lookup table. Hereinafter, the lightness "$L^*_{MAX}$" and "$L^*_{MIN}$" calculated by the pair of the maximum/minimum value calculator 17 and the gamma converting unit 1 is referred to as a "maximum lightness" and a "minimum lightness", respectively.

The center value calculating unit 18 calculates a center value of the maximum lightness and the minimum lightness calculated in the gamma converting unit 1. This center value is a value at which a distance from the maximum lightness and a distance from the minimum lightness are equal to each other. That is, the center value represents center of lightness corresponding to signal values of plural pixels in a spatial range to be targeted. As shown in Formula 3, for example, the center value $L^*_{MID}$ is able to be calculated by computing a mean value of the maximum and minimum lightness.

$$L^*_{MID}=(L^*_{MAX}+L^*_{MIN})/2 \quad \text{[Formula 3]}$$

The multiplier 10 multiplies the center value calculated in the center value calculating unit 18 by a value calculated depending on characteristic of the liquid crystal panel 16 (hereinafter, referred to as "lightness gain"). A multiplied value by the multiplier 10 is called "lightness modulation ratio" of the backlight 14.

In the present embodiment, the lightness gain K* can be calculated by Formula 4 wherein $D^*_p$ is a display dynamic range of the liquid crystal panel 16.

$$K^* = \frac{2}{1+1/D^*_p} \quad \text{[Formula 4]}$$

Here, the display dynamic range of the liquid crystal panel 16 is a value decided depending on a display contrast characteristic of the liquid crystal panel, and a value obtained by: (maximum displayable lightness)/(minimum displayable lightness) of the liquid crystal panel. For example, in a case where the liquid crystal panel has the contrast characteristic of a contrast ratio 1000:1 [(maximum displayable luminance):(minimum displayable luminance)], the display dynamic range of the liquid crystal panel here is $1000^{1/3}/1^{1/3}$, or 10.

By multiplying the lightness gain calculated thus by the center value in the calculated in the center value calculating unit 18, it is possible to make the center value calculated in the center value calculating unit 18 agree with the center of the range of the lightness displayable in the present image display apparatus. In the following, this will be explained more in detail.

When the center value calculated in the center value calculating unit 18 is represented by "$L^*_{MID}$" and the display dynamic range of the liquid crystal panel is represented by "$D^*_P$", the lightness modulation ratio "$L^*_{set}$" of the backlight calculated in the emission intensity calculating unit 11 is a value obtained by multiplying the center value $L^*_{MID}$ by the lightness gain K*, namely:

$$L^*_{SET} = \left(\frac{2}{1 + 1/D^*_P}\right) \times L^*_{MID}$$

In a case where the backlight 14 is lighted exactly with this modulation ratio, the maximum lightness $L^*_U$ and the minimum lightness $L^*_L$, which are displayable in the present image display apparatus is:

$$L^*_U = L^*_{SET},$$

$$L^*_L = (1/D^*_P) \times L^*_{SET}$$

Therefore, a center $L^*_C$ of the range of the lightness displayable in the present image display apparatus is:

$$L^*_C = \frac{L^*_U + L^*_C}{2}, \text{ namely}$$

$$\begin{aligned} L^*_C &= \frac{L^*_{SET} + (1/D^*_P) \times L^*_{SET}}{2}, \\ &= \frac{1 + (1/D^*_P)}{2} \cdot L^*_{SET}, \\ &= \frac{1 + (1/D^*_P)}{2} \cdot \left(\frac{2}{1 + (1/D^*_P)} \times L^*_{MID}\right), \\ &= L^*_{MID} \end{aligned}$$

Therefore, the center value calculated in the center value calculating unit 18 agrees with the center of the range of the lightness displayable in the present image display apparatus. In this manner, by multiplying the lightness gain calculated by the formula 4 by the center value of the maximum and minimum lightness calculated in the center value calculating unit 18, it is possible to make the center value of the maximum and minimum lightness calculated in the center value calculating unit 18 agree with the center of the range of the lightness displayable in the present image display apparatus.

The gamma converting unit 2 converts the inputted lightness modulation ratio $L^*_{SET}$ of the backlight into a luminance modulation ratio $L_{SET}$ by gamma conversion. This conversion is expressed for example by:

$$L_{SET} = (1-\alpha_2) \cdot L^{*\gamma_2}_{SET} + \alpha_2. \quad \text{[Formula 5]}$$

Here, "$\gamma_2$" and "$\alpha_2$" may be arbitral actual numbers, but in the case of performing the conversion in the most simplified manner, "$\alpha_2$=0.0" and "$\gamma_2$=3.0" are typically used. By performing the gamma conversion with "$\alpha_1$=0.0" and "$\gamma_1$=3.0", lightness is converted to luminance representing a criterion of brightness which is proportional to light energy. The conversion may be directly calculated by use of a multiplier or the like, or may be calculated by use of a lookup table.

Figure 5:
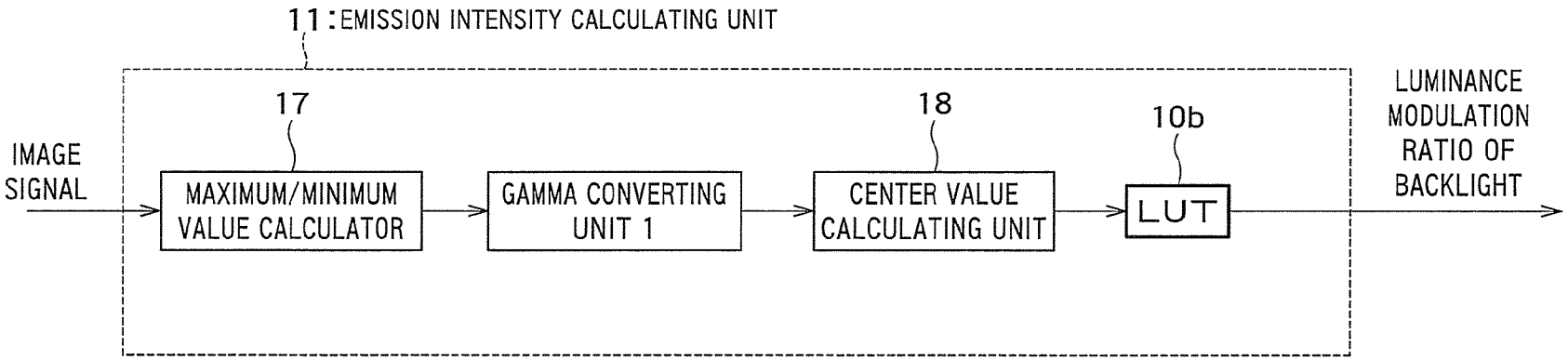
FIG. 5 is a view showing another constitution example of the emission intensity calculating unit according to the first embodiment.

The multiplication of the lightness gain and the gamma conversion of the lightness modulation ratio in the emission intensity calculating unit 11 may be carried out by means of the multiplier 10*a* and the gamma converting unit 2, or a lookup table (LUT) 10*b* shown in FIG. 5 which relates a center value of a maximum lightness and a minimum lightness and a luminance modulation ratio of the backlight to each other. The multiplier 10*a*, the gamma converting unit 2, or a lookup table (LUT) 10*b* can make up an intensity calculating unit.

It should be noted that even with the luminance modulation ratio of the backlight 14 calculated thus, if later-described correction of a light transmittance ratio of the image signal (correction of the luminance) is not made in the signal corrector 12, the display image is displayed darkly due to the modulation of the emission intensity of the backlight 14.

Moreover, the value of the lightness gain which is multiplied by the center value (between a maximum lightness and a minimum lightness) calculated in the center value calculating unit 18 is not restricted to the value calculated by the formula 4, but may be any value with which the center of the lightness range displayable by modulation of the emission intensity of the backlight 14 agrees with the center value of the lightness of the input image. Accordingly, the value by which the center value of the lightness is multiplied in the multiplier 10*a* may be a value close to the value calculated by the formula 4, or a value which is experientially and experimentally decided such that the center of the light range displayable by the modulation of the backlight emission intensity agrees with the center value of the lightness of the input image.

Modified Example of Emission Intensity Calculating Unit 11

Figure 6A:
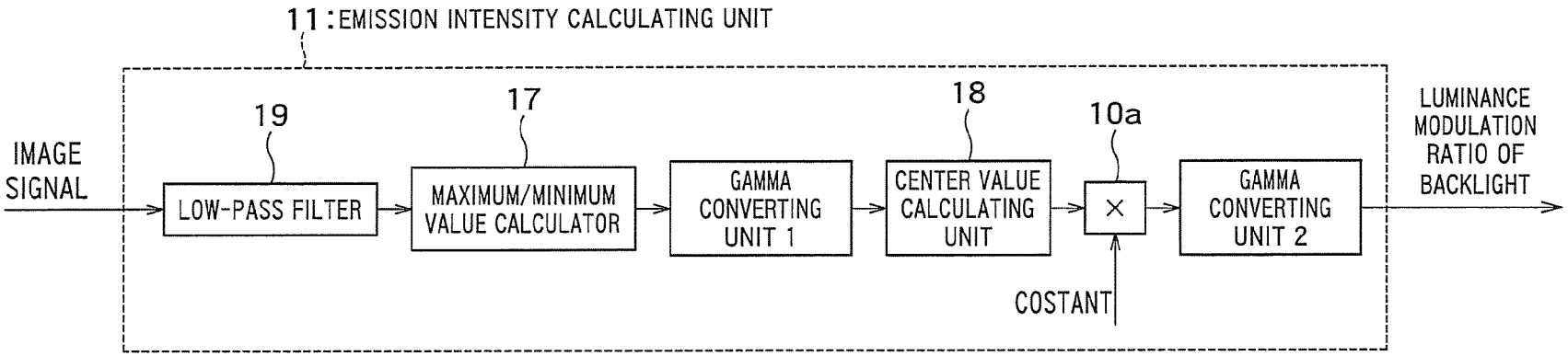
FIGS. 6A and 6B are views showing another constitution example of the emission intensity calculating unit according to the first embodiment.

In the emission intensity calculating unit 11, as shown FIG. 6A, a spatial low-pass filter 19 such as a Gaussian filter may be arranged at preceding stage toward the maximum/minimum value calculator 17 to carry out a low-pass filtering on the image signal before calculating the maximum value and the minimum value.

The low-pass filter 19 calculates a weighted mean based on image signals in proximity to an image signal to be processing target and obtains the weighted mean as a new image signal corresponding to the image signal, and iteratively carries out these processing on the image signals of each coordinate point. Specifically, the new image signal is calculated by:

$$S'(x, y) = \left[\sum_{y'=-r_y}^{r_y} \sum_{x'=-r_x}^{r_x} \{w(x', y') \cdot S(x + x', y + y')\}\right] \Big/ \left[\sum_{y'=-r_y}^{r_y} \sum_{x'=-r_x}^{r_x} w(x', y')\right]$$

based on image signals before the filtering.

Here, S'(x, y) is a value of a new image signal at a coordinate point (x, y), S(ξ, ψ) is a value of an image signal before the filtering at a coordinate point (ξ, ψ), w(ξ, ψ) is a weight at a coordinate point (ξ, ψ) and $r_x$ and $r_y$ is a radius of a weight table.

In this manner, it can be prevented that the maximum and minimum values calculated in the maximum/minimum value calculator 17 depend only signals of a small number of pixels in the image, a time change of the emission intensity of the backlight 14 can be stabilized and flicker on a displayed image which occurs due to the time change of the emission intensity of backlight 14 can be prevented.

Figure 6B:
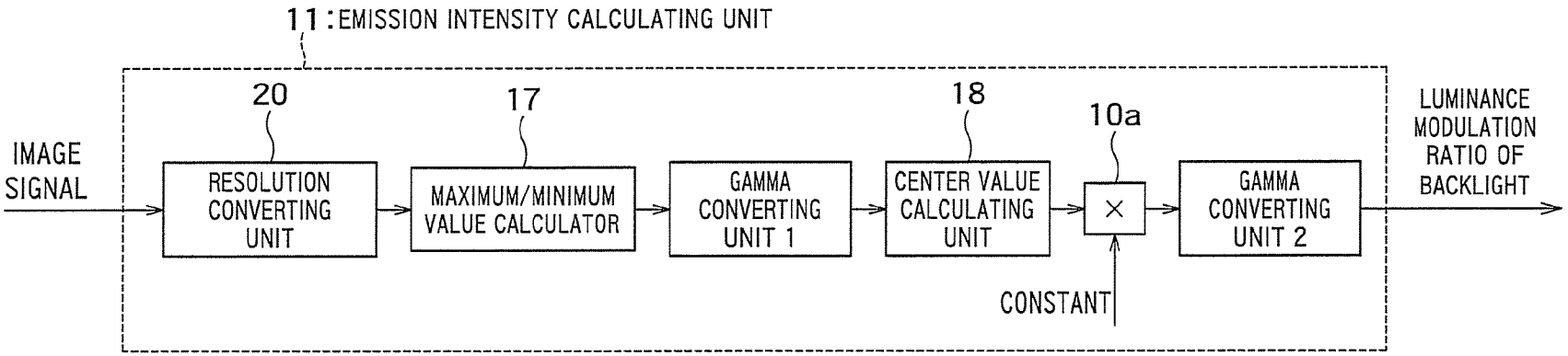

Alternatively, in the emission intensity calculating unit 11, as shown FIG. 6B, a resolution converting unit 20 may be arranged at preceding stage toward the maximum/minimum value calculator 17 to carry out a resolution conversion on the image signal before calculating the maximum value and the minimum value. The resolution converting unit 20 converts an image signal inputted into the image display apparatus into a signal with a rougher space resolution than that of the image signal. As a resolution converting technique of the resolution converting unit 20, there can be used a technique for applying a low-pass filter to input signals and then sparsely sampling the input signals or a known resolution converting technique. In this manner, according to a spatial low-pass filter effect by the resolution conversion, flicker on a displayed image which occurs due to the time change of the emission intensity of backlight 14 can be prevented as stated above and besides, a quantity of pixels to be processing target in the maximum/minimum value calculator 17 can be reduced and accordingly, calculation amount in the maximum/minimum value calculator 17 can be reduced.

Signal Corrector 12

Figure 7:
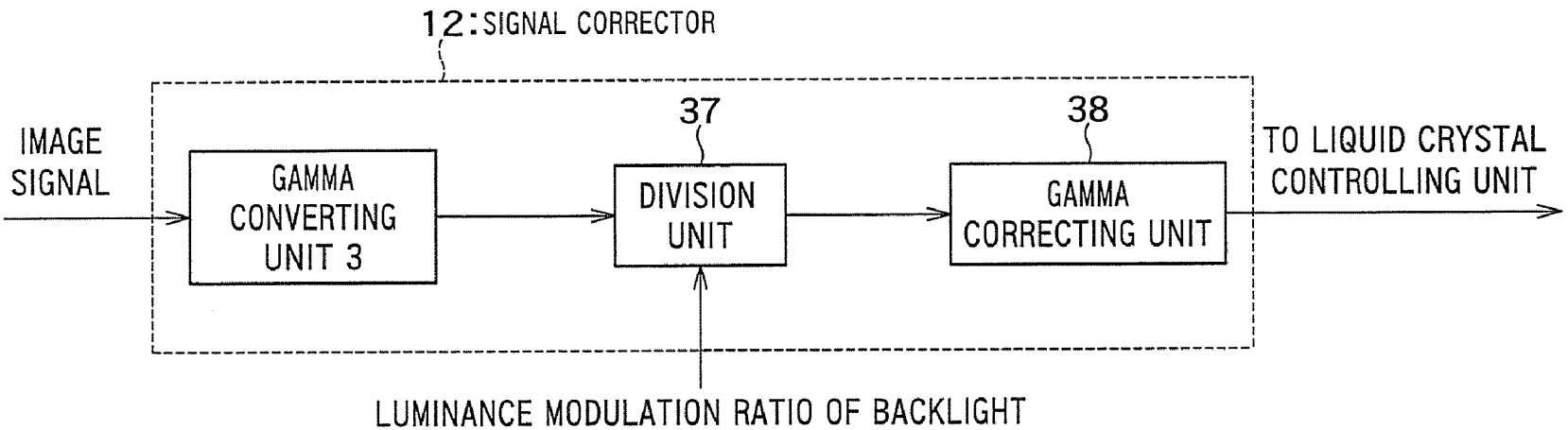
FIG. 7 is a view showing a constitution example of a signal corrector according to the first embodiment.
Figure 8:
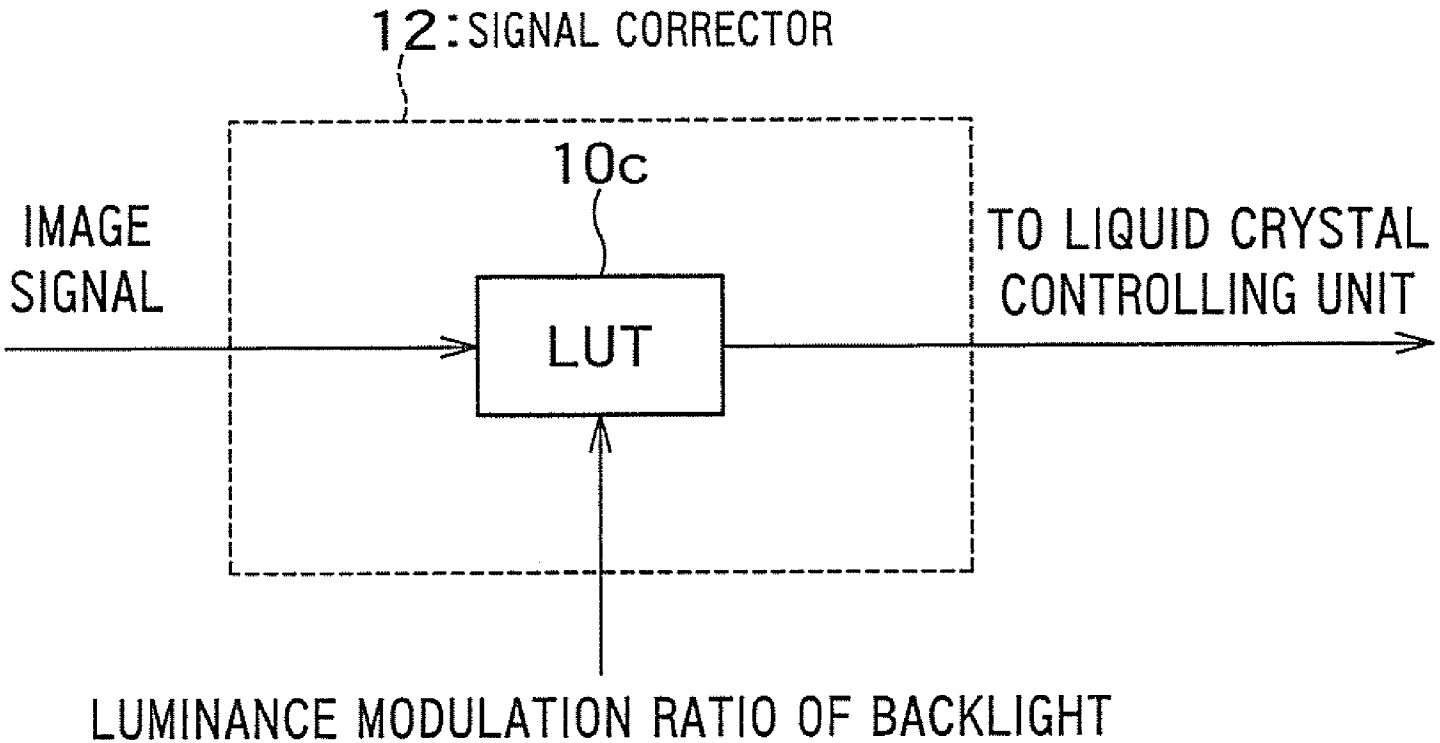
FIG. 8 is a view showing another constitution example of the signal corrector according to the first embodiment.

The signal corrector 12 corrects the luminance (transmittance) of the image signal in each pixel in the liquid crystal panel 16 based upon the inputted image signal and the luminance modulation ratio of the backlight 14 which was calculated in the emission intensity calculating unit 11, and outputs the corrected image signal to the liquid crystal controlling unit 15. FIG. 7 shows one specific example of this signal corrector 12.

This signal corrector 12 includes a gamma converting unit 3, a division unit 37 and a gamma correcting unit 38.

The gamma converting unit 3 converts the inputted image signal into light transmittances of "R", "G" and "B". Namely, the gamma converting unit 3 performs conversion expressed by Formula (6) when the image signal to be inputted is a signal in the range of [0, 255]:

$$\begin{cases} T_R = (1-\alpha_3)(S_R/255)^{\gamma_3} + \alpha_3, \\ T_G = (1-\alpha_3)(S_G/255)^{\gamma_3} + \alpha_3, \\ T_B = (1-\alpha_3)(S_B/255)^{\gamma_3} + \alpha_3, \end{cases} \quad \text{[Formula 6]}$$

Here, "$S_R$", "$S_G$" and "$S_B$" are image signal values corresponding to "R", "G" and "B", and "$T_R$", "$T_G$" and "$T_B$" are light transmittances respectively corresponding to the colors of "R", "G" and "B". Values of "$\gamma_3$" and "$\alpha_3$" of the gamma converting unit 3 may be arbitrary actual numbers, but "$\alpha_3$=0.0" and "$\gamma_3$=2.2" can be typically employed in case where this conversion is carried out in the simplest way.

The division unit 37 divides the light transmittances of "R", "G" and "B" of each pixel, which were calculated by the gamma converting unit 3, by the luminance modulation ratio of the backlight 14 which was calculated in the emission intensity calculating unit 11, and thereby obtains the corrected light transmittance. That is, computation by the division unit 37 may be performed by dividing the light transmittances of "R", "G" and "B" of each pixel, which were calculated by the gamma converting unit 31, by the luminance modulation ratio of the backlight 14 which was calculated in the emission intensity calculating unit 11. But the computation may be performed by previously holding a lookup table in the division unit 37 that relates between input and output and calculating a corrected light transmittance with reference to this lookup table.

The gamma correcting unit 38 makes a gamma correction on the corrected light transmittance obtained in the division unit 37, and converts the corrected light transmittance into an image signal to be outputted to the liquid crystal controlling unit 15. Assuming that the image signal to be outputted is in the range of [0, 255] which corresponds to "R", "G" and "B", this gamma correction is made for example by using Formula (7) below:

$$\begin{cases} S'_R = 255 \times \{(T'_R - \alpha_4)/(1-\alpha_4)\}^{1/\gamma_4}, \\ S'_G = 255 \times \{(T'_G - \alpha_4)/(1-\alpha_4)\}^{1/\gamma_4}, \\ S'_B = 255 \times \{(T'_B - \alpha_4)/(1-\alpha_4)\}^{1/\gamma_4}, \end{cases} \quad \text{[Formula 7]}$$

Here, $T'_R$, $T'_G$ and $T'_B$ are respectively corrected light transmittances corresponding to the colors of "R", "G" and "B", and "$S'_R$", "$S'_G$" and "$S_B$" are respectively output image signal values corresponding to "R", "G" and "B". "$\gamma_4$" and "$\alpha_4$" may be arbitral actual numbers, but if "$\gamma_4$" is a gamma value of the liquid crystal panel 16 and "$\alpha_4$" is a minimum light transmittance of the liquid crystal panel 16, it is possible to reproduce an image faithful to an input signal. Moreover, a gamma correction is not restricted to this conversion, but may be substituted by a known conversion scheme according to need, or may be reversed conversion based on a gamma conversion table of the liquid crystal panel 16. These conversions may be directly calculated by use of the multiplier or the like, or may be calculated by use of the lookup table.

Modified Example of Signal Corrector 12

Since the operation of the signal corrector 12 is decided in accordance with the inputted luminance modulation ratio of the backlight 14 and image signal, the signal corrector 12, as shown in FIG. 3, may be configured to calculate an corrected image signal with reference to a lookup table 10*c* which is previously created based upon the luminance modulation ratio of the backlight which was calculated in the emission intensity calculating unit 11 and the image signal.

Effect Relevant to Signal Corrector 12

Figure 9A:
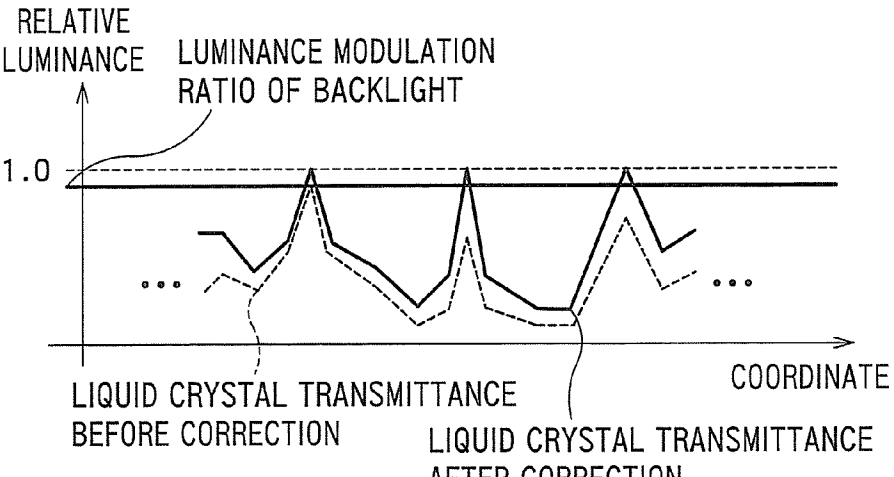
FIGS. 9A and 9B are views explaining an effect due to an operation of the signal corrector according to the first embodiment.
Figure 9B:
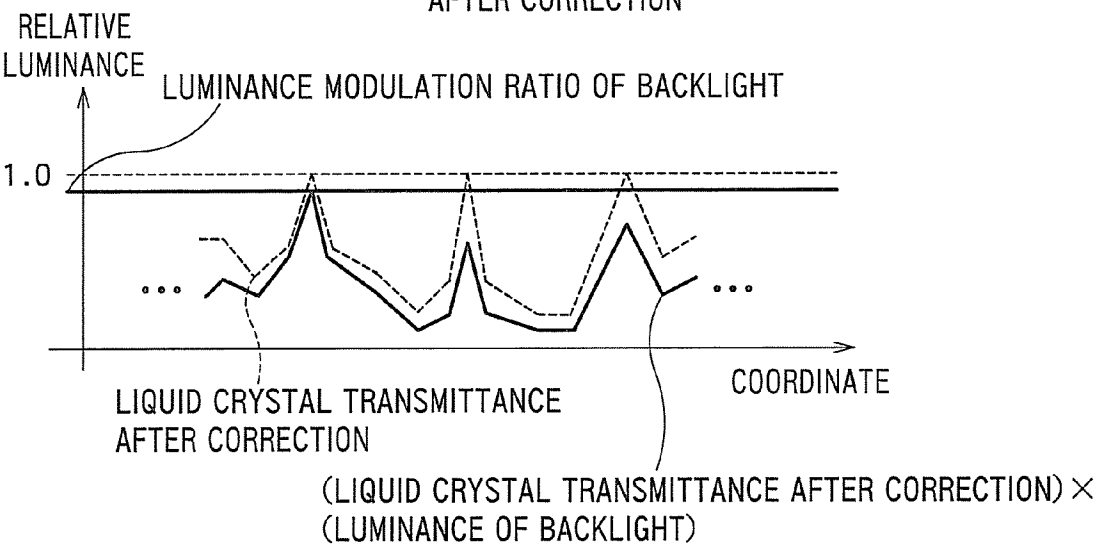

The effect due to the operation of the signal corrector 12 is described with reference to FIGS. 9A and 9B. The light transmittance before the correction is assumed in the case that the relative luminance of the backlight 14 being the maximum, namely 1.0. Therefore, in the case of changing the luminance of the backlight 14 without correction of the light transmittance of the liquid crystal, an actual display becomes vastly different from a display assumed by the inputted image signal. Thereat, the light transmittance of the liquid crystal is corrected in the signal corrector 12 by use of the luminance modulation ratio of the backlight 14 which was calculated in the emission intensity calculating unit 11. The signal corrector 12 divides the light transmittance before the correction by the luminance modulation ratio of the backlight 14 which was calculated in the emission intensity calculating unit 11. Thereby, as shown in FIG. 9A, the corrected light transmittance is set largely as compared with the light transmittance before the correction. Since an image presented to a viewer can be approximated by "(luminance of backlight)×(light transmittance of liquid crystal)", as shown in FIG. 9B, a video image of a relative luminance obtained by multiplying the corrected light transmittance by the luminance of the backlight 14 is displayed, and thereby a display close to the display assumed by the inputted image signal can be obtained.

Effect Relevant to Emission Intensity Calculating Unit 11 and Signal Corrector 12

Figure 10:
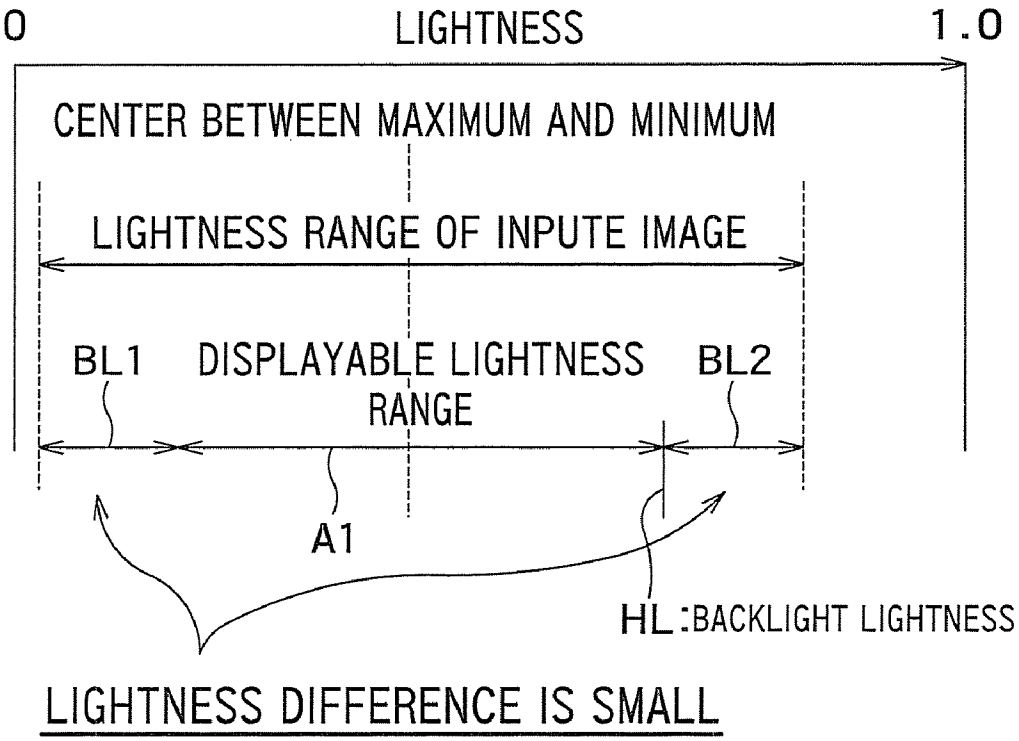
FIG. 10 is a view specifically explaining an effect according to the first embodiment.

FIG. 10 is a view schematically showing an operation of the emission intensity calculating unit 11 in the present embodiment.

In FIG. 10, a lateral axis represents lightness (which represents a criterion for brightness which is proportional to perception of human). As stated above, the emission intensity calculating unit 11 in the present embodiment calculates the emission intensity of the backlight 14 such that the center value between the maximum lightness and the minimum lightness, calculated in the center value calculating unit 18 agrees with a center of lightness range displayable in the present image display apparatus. When lightness of signal values of pixels in the inputted image is distributed in a range shown by a upper arrow in FIG. 10, therefore, the backlight 14 emits a light at lightness shown by a thick vertical line HL in FIG. 10 since the emission intensity calculating unit 11 calculates lightness of the backlight 14 such that a center of maximum and minimum values in the lightness distribution agrees with a center of a lightness range displayable in the present image display apparatus. This results in that a range shown by a lower arrow A1 corresponds to the lightness range displayable in the present image display apparatus. Consequently, pixels having at least signal values of lightness in ranges of BL1 and BL2 among a plurality of pixels in the inputted image cannot be faithfully reproduced at lightness depending on inputted signal values. Accordingly, a maximum error observed in a displayed image for lightness of the inputted image is a lightness difference of magnitude shown by arrows BL1 and BL2 in FIG. 10.

By such an operation of the emission intensity calculating unit 11, a maximum error observed in a displayed image for lightness of the inputted image can be minimized in the present embodiment.

In contrast, if the backlight 14 is lighted such that a maximum lightness of image signals agrees with lightness of the backlight 14, the lightness of the backlight 14, that is, an upper limit of a displayable lightness range is closed to an upper side of lightness and accordingly an lower limit of the displayable lightness range is also closed to the upper side of the lightness, and consequently, an error in a low side of the lightness become large. In other words, a maximum error observed in a displayed image becomes larger in a dark part. Accordingly, in the displayed image, image deterioration is outstood such that black becomes like white.

As stated above, according to the present embodiment, there is calculated the emission intensity of the backlight 14 such that the center value between the maximum lightness and the minimum lightness, calculated in the center value calculating unit 18 (i.e. a center value of lightness of signals of pixels included in a spatial range to be targeted) agrees with a center of lightness range displayable in the present image display apparatus. Therefore, the maximum error generated in the displayed image for lightness of the inputted image can be minimized.

Generally, it can be said that visual sensitivity increases proportionally to size of stimulus when the size of stimulus is very small (diameter is less than about 0.1 [deg] or equal to), when the size of stimulus is larger than that, the size of stimulus gives only small influence on light perception and the visual sensitivity depends on only the stimulus intensity ("Visual Information Processing Handbook," Asakura Publishing, 5.1.2a: threshold area curve (Ricco's law)).

Therefore, in order to reduce subjective image deterioration, it is more effective to make a size of an error smaller than to reduce size of an area which holds error or amount of pixels which hold error.

According to the present embodiment, since it is possible to minimize lightness difference (an error) generated on the displayed image, it is possible to suppress the subjective image deterioration to the minimum.

Furthermore, in the present embodiment, the gamma conversion is carried out with "$\alpha_1$=0.0" and "$\gamma_1$=2.2/3.0" in the gamma converting unit 2 to convert a signal value to a value of lightness. As stated above, the lightness represents a criterion of brightness which is proportional to perception of human, while luminance is a criterion of brightness which is proportional to light energy. Generally, the luminance is not proportional to intensity of brightness that human can perceive. Hence, in order to evaluate difference of brightness that human perceives, it is appropriate to utilize a difference of lightness but not a difference of luminance. In this manner, according to the present embodiment, it is possible to minimize a lightness difference (an error) observed on the displayed image, and thereby it is possible to suppress image deterioration to the minimum.

(Complement) Contrast Characteristic and Displayable Range of Liquid Crystal Panel 16

The reason why a displayable lightness range is restricted to the range shown by FIG. 10 with respect to lightness of the backlight 14 is that there is a limit for a minimum transmittance that can be achieved due to contrast characteristic of the liquid crystal panel 16. For example, when a contrast ratio of the liquid crystal panel 16 is 1000:1, only a range from 1/10 to 1 times lightness of the backlight 14 can be displayed in the liquid crystal panel 16.

Furthermore, since a lightness range to be able to modulated in a liquid crystal panel is generally narrow as compared with a range of lightness in the image signals, there may occur a case that inputted image signals cannot be faithfully reproduced no matter how lightness of the backlight 14 is modulated. For example, when lightness of the inputted image signals is widely distributed from 0 to 1, it is impossible to reproduce faithfully all of the inputted image signals in the liquid crystal panel.

When most of the inputted image signals correspond to a dark portion and only a portion of the inputted image signals corresponds to a bright portion and when the backlight is lighted such that lightness of the backlight 14 agrees with a maximum lightness of the image signals, a light portion corresponding to the only portion of the image signals can be faithfully reproduced, but a dark portion corresponding to the most of the image signals cannot be faithfully reproduced.

Liquid Crystal Panel 16 and Liquid Crystal Controlling Unit 15

Figure 11:
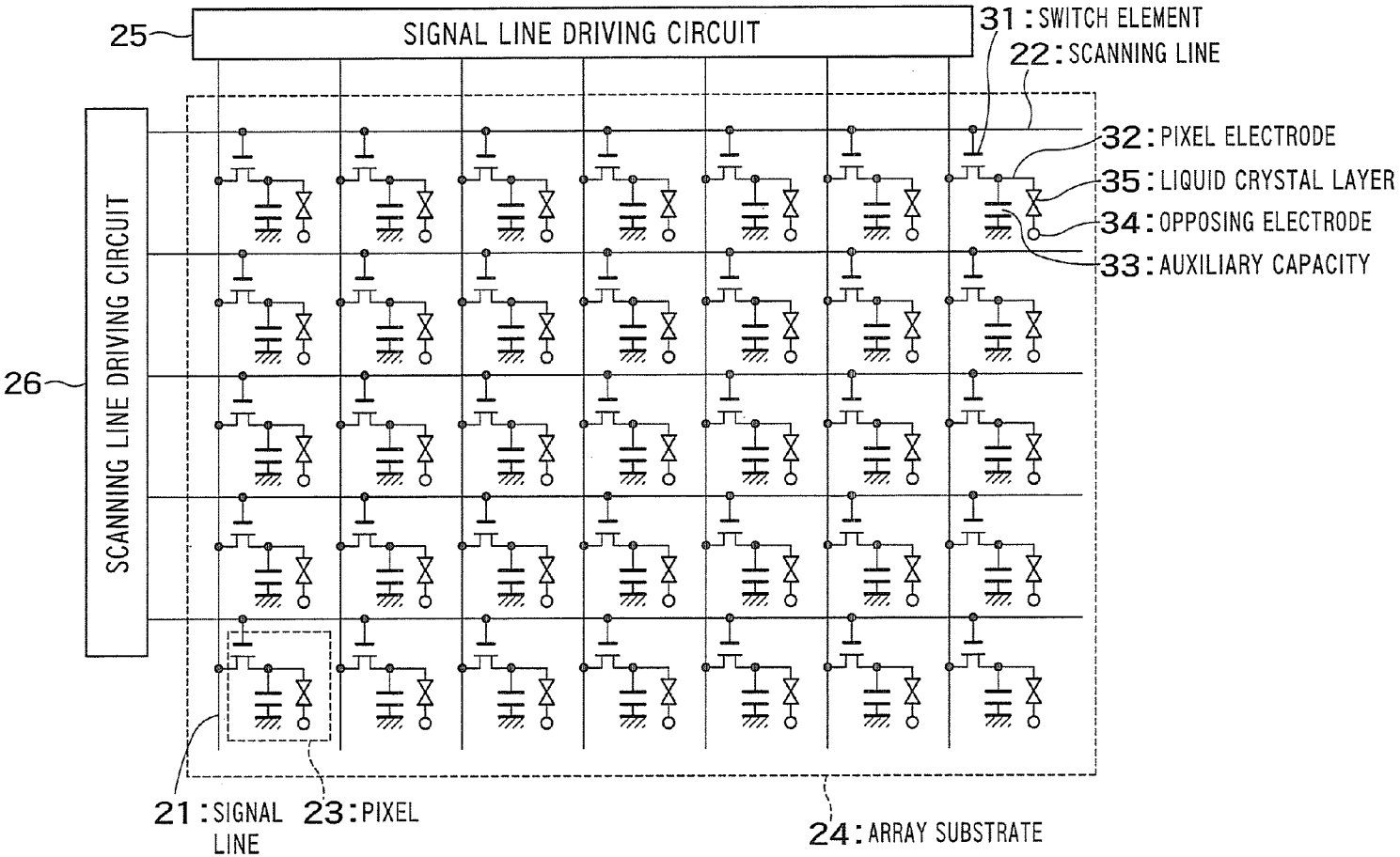
FIG. 11 is a view showing a constitution example of a liquid crystal panel.

The liquid crystal panel 16 is an active matrix type in the present embodiment, and as shown in FIG. 11, on an array substrate 24, a plurality of signal lines 21 and a plurality of scanning lines 22 intersecting with the signal lines are arranged through an insulating film, not shown, and a pixel 23 is formed in each intersecting region of the two lines. The ends of the signal lines 21 and the scanning lines 22 are respectively connected to a signal line driving circuit 25 and a scanning line driving circuit 26. Each pixel 23 includes a switch element 31 made up of a thin-film transistor (TFT), a pixel electrode 32, a liquid crystal layer 35, an auxiliary capacity 33 and an opposing electrode 34. It is to be noted that the opposing electrode 34 is an electrode common to every pixel 23.

The switch element 31 is a switch element for writing an image signal, its gate is connected to the scanning line 22 in common on each one horizontal line, and its source is connected to the signal line 21 in common on each one vertical line. Further, its drain is connected to the pixel electrode 32 and also connected to the auxiliary capacity 33 electrically arranged in parallel with this pixel electrode 32.

The pixel electrode 32 is formed on the array substrate 24, and the opposing electrode 34 electrically opposed to this pixel electrode 32 is formed on an opposing substrate, not shown. A prescribed opposing voltage is given to the opposing electrode 34 from an opposing voltage generating circuit, not shown. Further, the liquid crystal layer 35 is held between the pixel electrode 32 and the opposing electrode 34, and the peripheries of the array substrate 24 and the above-mentioned opposing substrate are sealed by a seal material, not shown. It is to be noted that a liquid crystal material used for the liquid crystal layer 35 may be any material, but for example, a ferroelectric liquid crystal, a liquid crystal in an OCB (Optically Compensated Bend) mode, or the like is suitable as the liquid crystal material.

The scanning line driving circuit 26 is configured of a shift resistor, a level shifter, a buffer circuit and the like, which are not shown. This scanning line driving circuit 26 outputs a row selection signal to each scanning line 22 based upon a vertical start signal and a vertical clock signal outputted as control signals from a display ratio controlling unit, not shown.

The signal line driving circuit 25 is configured of an analog switch, a shift resistor, a sample hold circuit, a video bus and the like, which are not shown. A vertical start signal and a vertical clock signal outputted as control signals from the display ratio controlling unit, not shown, are inputted into the signal line driving circuit 25, and also an image signal is inputted therein.

The liquid crystal controlling unit 15 controls the liquid crystal panel 16 so as to have a liquid crystal transmittance after the correction by the signal corrector 12.

Effect Relevant to Present Embodiment

According to the image display apparatus relevant to the present embodiment, it is possible to minimize lightness difference (an error) observed in the displayed image, and accordingly, it is possible to suppress subjective image deterioration to the minimum and make an image display with a wide dynamic range and low consumption power.

Second Embodiment

An image display apparatus according to a second embodiment of the present invention will be described with reference to drawings.

Configuration of Image Display Apparatus

Figure 12:
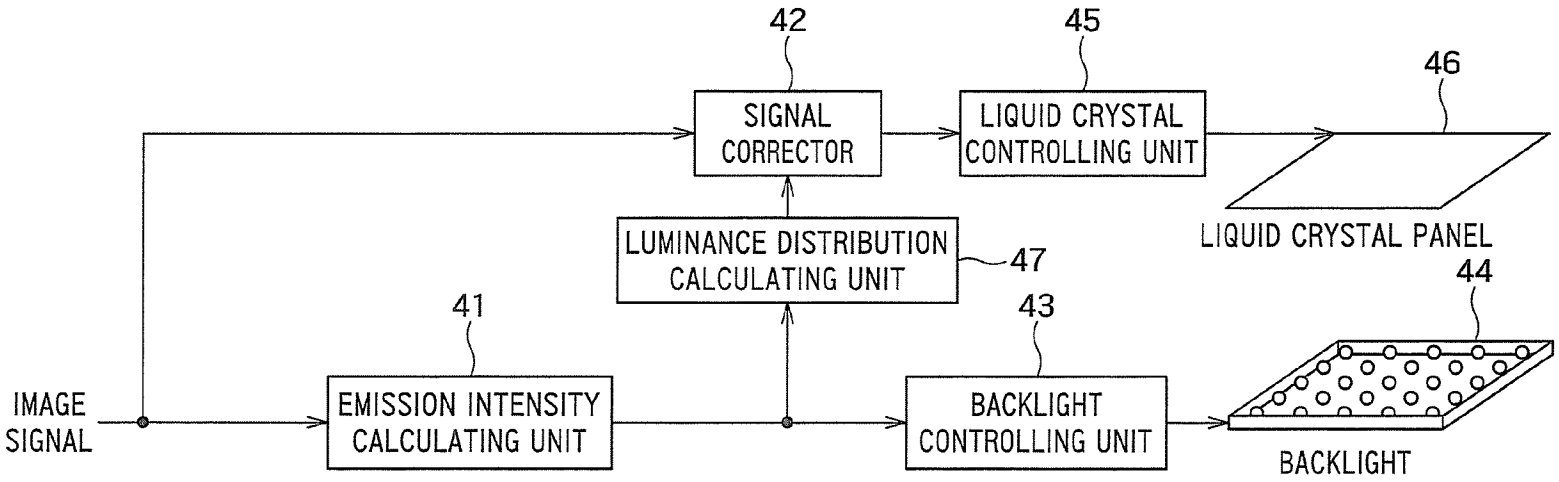
FIG. 12 is a view showing a constitution example of an image display apparatus according to a second embodiment.

FIG. 12 shows a configuration of the image display apparatus according to the present embodiment. The image display apparatus according to the second embodiment is vastly different from the image display apparatus according to the first embodiment in that the emission intensity and the light-emission timing of each of a plurality of light sources constituting a backlight are individually controllable by a backlight controlling unit 43. Further, the image display apparatus according to the present embodiment desirably has a luminance distribution calculating unit 47, and in the present embodiment, it is assumed that the apparatus has the luminance distribution calculating unit 47.

In the following, the configuration and operation of each unit are described in detail.

Backlight 44

The backlight 44 has a plurality of light sources. These light sources are individually lighted strongly or weakly by control of the backlight controlling unit 43, and irradiate the liquid crystal panel 46 from the back surface thereof.

Figure 13:
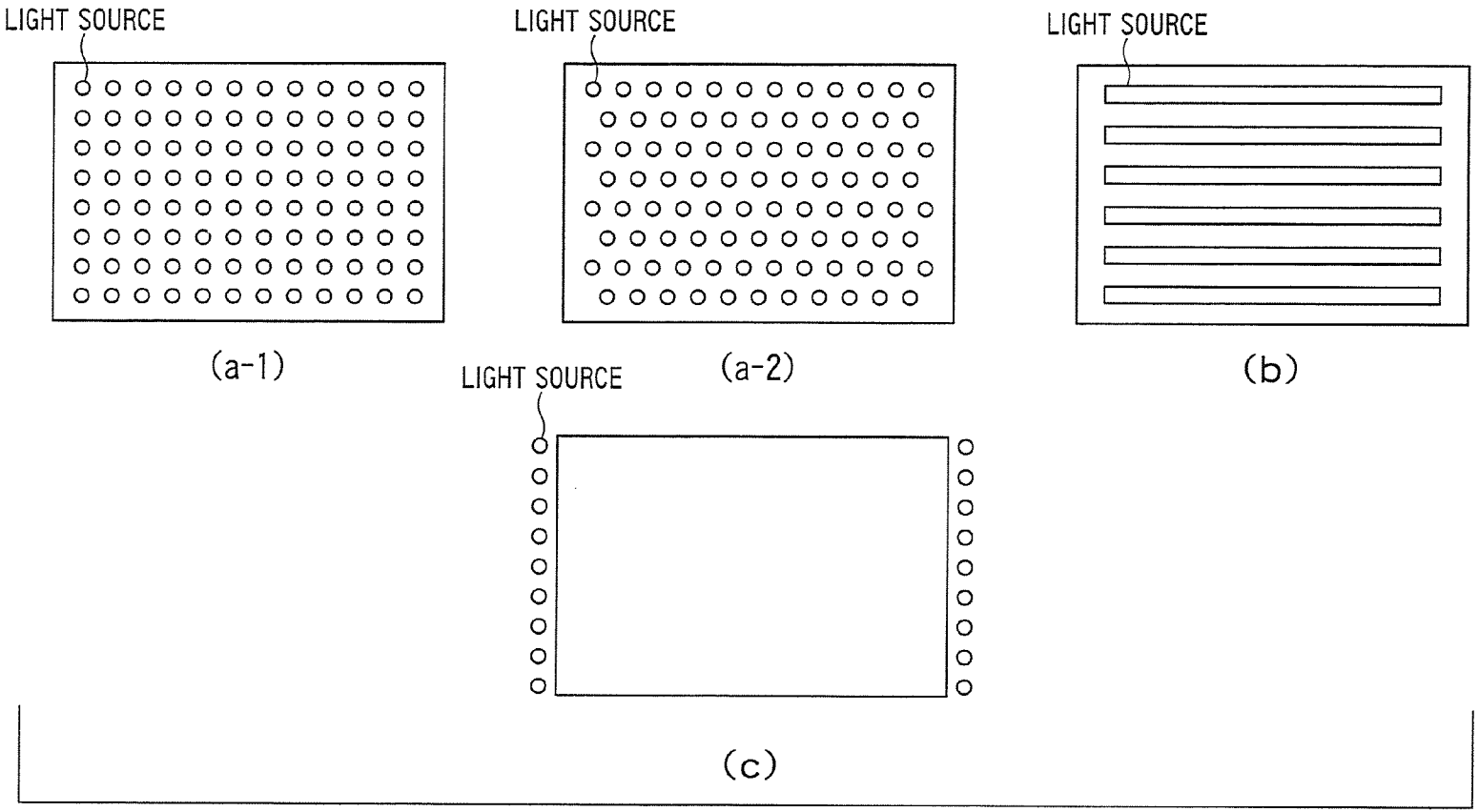
FIG. 13 is a view showing a constitution example of a backlight according to the second embodiment.

FIG. 13(*a*-1), (*a*-2), (*b*), and (*c*) show a configuration of one specific example of this backlight 44. As shown in FIG. 13(*a*-1), (*a*-2), (*b*), and (*c*), the backlight has at least not less than one light sources. The arrangement of the light sources may be a direct type as shown in FIG. 13(*a*-1), (*a*-2), and (*b*), where the light sources are arranged on the back surface of the liquid crystal panel 46, or may be an edge light type as shown in FIG. 13(*c*), where the light sources are arranged on the side surfaces of the liquid crystal panel 46 and light is led to the back surface of the liquid crystal panel 46 by a light guiding board or a reflector, not shown, to irradiate the liquid crystal panel 46 from the back surface thereof.

Figure 14B:
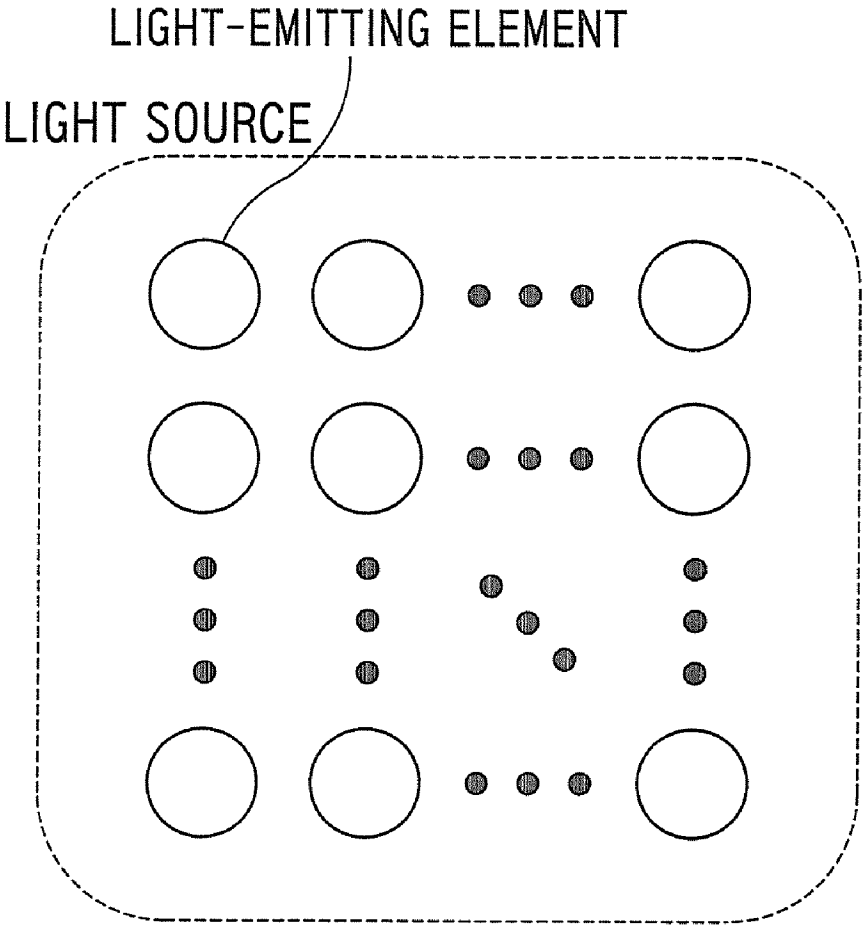
FIGS. 14A and 14B are views showing a constitution example of a light source, respectively.
Figure 14A:
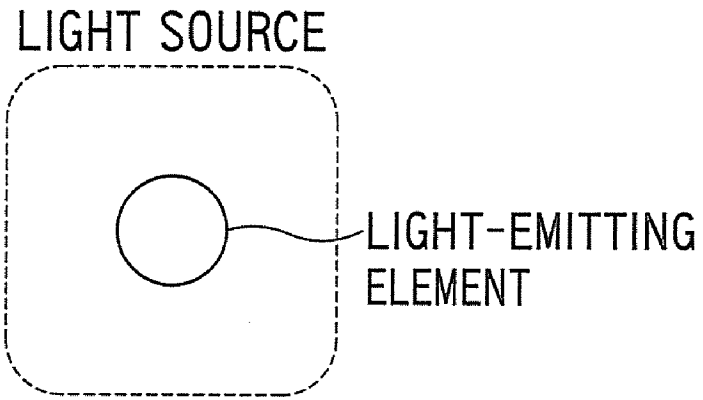

Although each light source is shown in FIG. 13 as if it is configured of a single light-emitting element, the light source may be configured of a single light-emitting element as in FIG. 14A, or may be configured such that a plurality of light-emitting elements are arranged along a surface which is parallel or vertical to the liquid crystal panel 46 as in FIG. 14B.

An LED, a cold-cathode tube, a hot-cathode tube, and the like are suitable for the light-emitting element. The LED is particularly preferably used as the light-emitting element since the LED has a large width between the maximum light emittable luminance and the minimum light emittable luminance and hence its light emission can be controlled in a high dynamic range. The emission intensity (emission luminance) and the light-emission timing of the light source are controllable by the backlight controlling unit 43.

Backlight Controlling Unit 43

The backlight controlling unit 43 makes each light source, constituting the backlight 44, lighted strongly or weakly based upon the luminance modulation ratio of each light source calculated by the emission intensity calculating unit 41. The backlight controlling unit 43 is capable of independently controlling the emission intensity (emission luminance) and the light-emission timing of each light source constituting the backlight 44.

Emission Intensity Calculating Unit 41

Figure 15:
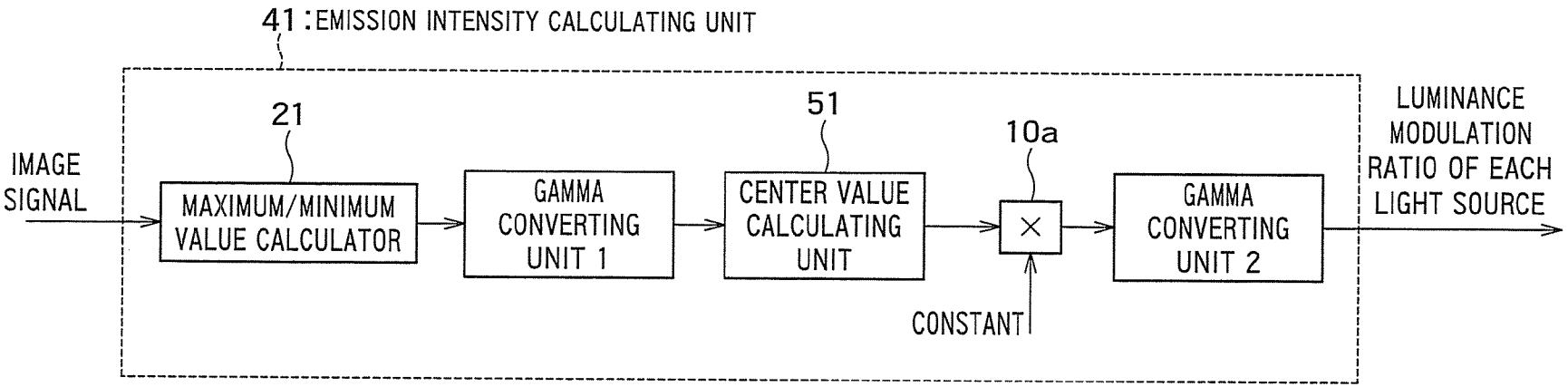
FIG. 15 is a view showing a constitution example of a emission intensity calculating unit according to the second embodiment.

FIG. 15 shows a constitution example of the emission intensity calculating unit 41 according to the second embodiment. The emission intensity calculating unit 41 calculates, from an image signal, a luminance modulation ratio of each light source which is suitable for a display. With respect to the emission intensity calculating unit 41 according to the second embodiment, a configuration of a maximum/minimum value calculator 21 is vastly different from the maximum/minimum value calculator 17 in the emission intensity calculating unit 11 according to the first embodiment.

The maximum/minimum value calculator 21 of the emission intensity calculating unit 41 according to the second embodiment finds, with respect to each light source constituting the backlight 44, a maximum value and a minimum value from the signal values of a plurality of pixels within a spatial range corresponding to an irradiation range of each light source on the liquid crystal panel 46. The spatial range to be targeted for obtaining the maximum and minimum values with respect to each light source may substantially agree with the irradiation range of each light source, or may be larger or smaller than this.

The gamma converting unit 1 in the second embodiment performs gamma conversion on maximum and minimum values out of signal values inputted correspondingly each light source in a similar way as the gamma converting unit 1 in the first embodiment and thereby converts them to maximum and minimum lightness for each light source.

The center value calculating unit 51 in the second embodiment calculates a center value of the maximum and minimum lightness for each light source, respectively based on the maximum and minimum lightness obtained in the gamma converting unit 1 as in a similar way as the center value calculating unit 18 in the first embodiment.

The emission intensity calculating unit 41 in the second embodiment multiplies a value (lightness gain) calculated depending on characteristic of the liquid crystal panel 46 by the center value for each light source calculated in the center value calculating unit 51 in a similar way as the emission intensity calculating unit 11 in the first embodiment and thereby obtains a lightness modulation ratio for each light source in the backlight 44, respectively.

The gamma converting unit 2 in the second embodiment performs gamma conversion on the lightness modulation ratio calculated for each light source in a similar way as the gamma converting unit 2 in the first embodiment and thereby converts the lightness modulation ratio for each light source to a luminance modulation ratio for each light source, respectively.

Luminance Distribution Calculating Unit 47

The luminance distribution calculating unit 47 according to the second embodiment estimates the luminance distribution of light that is actually incident on the liquid crystal panel 46 when each light source are lighten at respective luminance modulation ratio which were calculated by the emission intensity calculating unit 41.

Figure 16:
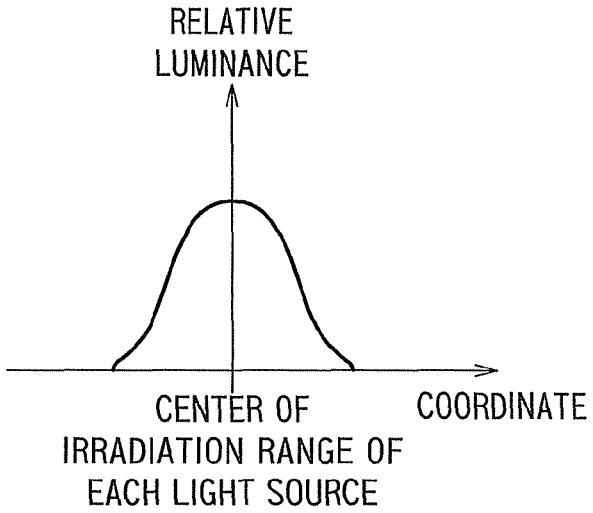
FIG. 16 is a view showing an example of a luminance distribution of the light source.

Since each light source of the backlight 44 has a light-emission distribution in accordance with an actual hardware configuration, the intensity of light incident on the liquid crystal panel 46 by lightening of the light source also has a distribution in accordance with the actual hardware configuration. Here, the intensity of the light incident on the liquid crystal panel 46 is expressed simply as the luminance of the backlight or the luminance of the light source. FIG. 16 shows an example of the luminance distribution of the light source. This luminance distribution is a distribution symmetrical to the center of the irradiation range of each light source, and the relative luminance decreases as backed away from the center of the irradiation range of the light source. The relative luminance at each coordinate at the time of lightening the n-th light source "n" with a luminance modulation ratio "$L_{SET,n}$", can be expressed using this luminance distribution:

$$L_{BL}(x'_n,y'_n)=L_{SET,n}\cdot L_{P,n}(x'_n,y'_n) \quad \text{[Formula 8]}$$

In Formula (8), $(x'_n, y'_n)$ represents a relative coordinate point from the center of the irradiation range of the light source "n", and "$L_{p,n}$" is a luminance of the light source "n" at that point.

The luminance of each pixel at the time of lighting each light source of the backlight 44 with the luminance modulation ratio "$L_{SET,n}$" is calculated as a sum of values obtained by multiplying the luminance at the pixel by each light source by the luminance modulation ratio of each light source.

Figure 17:
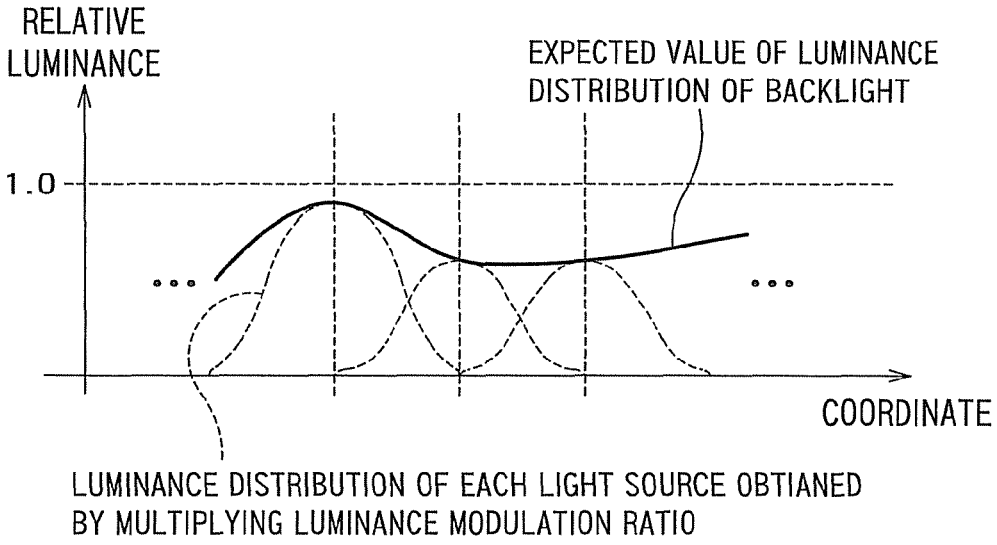
FIG. 17 is a view schematically showing a method for calculating a luminance distribution of the backlight.

FIG. 17 schematically shows a method for calculating the luminance distribution (luminance of each pixel) of the backlight. Specifically, the luminance distribution of the backlight is calculated by Formula (9) below by use of the luminance distribution "$L_{p,n}$".

$$L_{BL}(x, y) = \sum_{n=1}^{N} \{L_{SET,n} \cdot L_{P,n}(x - x_{0,n}, y - y_{0,n})\} \quad \text{[Formula 9]}$$

In Formula (9), (x, y) is a coordinate of a pixel on the liquid crystal panel 46, and $(x_{0,n}, y_{0,n})$ is a coordinate of the center of the irradiation range of the light source "n" on the liquid crystal panel 46. Symbol "N" denotes a total number of light sources. In Formula (9), although it is defined that the luminance modulation ratio and the luminance distribution of every light source is used for obtaining the luminance in a certain pixel, a luminance modulation ratio and a luminance distribution of a light source which have a small influence on the luminance of that pixel can be omitted for calculation of the luminance of the pixel.

The luminance distribution of each light source may be directly calculated by approximation with an appropriate function, or may be calculated using a previously prepared lookup table.

Signal Corrector 42

Figure 18:
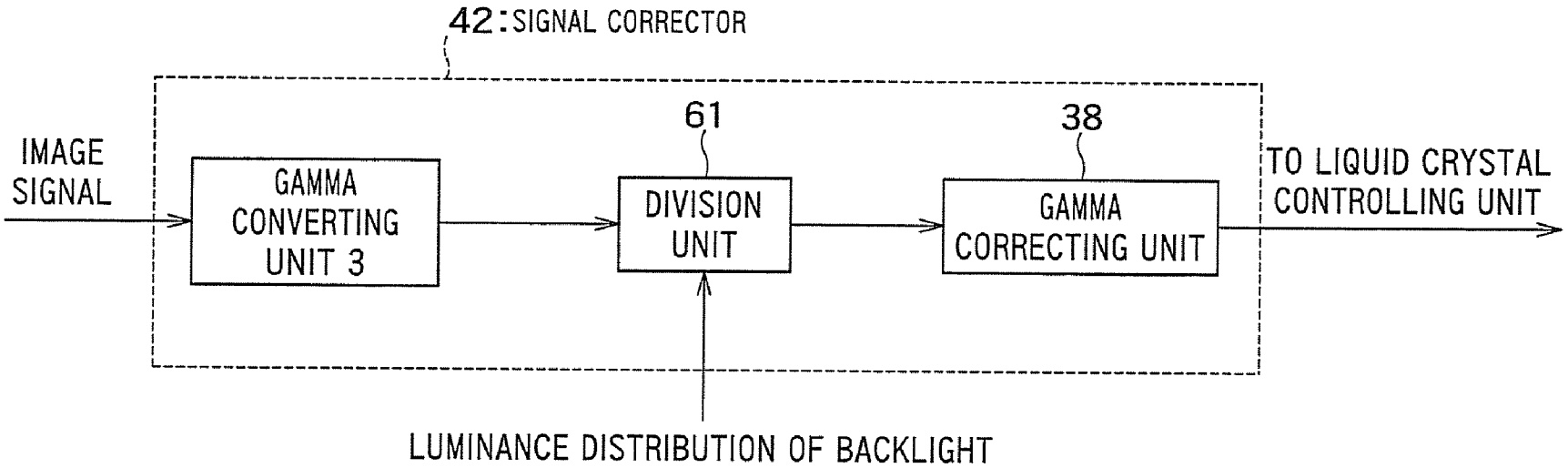
FIG. 18 is a view showing a constitution example of a signal corrector according to the second embodiment.

The signal corrector 42 corrects a transmittance of an image signal in each pixel of the liquid crystal panel 46 based upon the inputted image signal and the luminance distribution of the backlight which was calculated in the luminance distribution calculating unit 47, and outputs the image signal with the corrected transmittance to a liquid crystal controlling unit 45. FIG. 18 shows a configuration of one specific example of this signal corrector 42.

This signal corrector 42 includes the gamma converting unit 3, a division unit 61 and the gamma correcting unit 38.

The signal corrector 42 according to the second embodiment is vastly different from the signal corrector 12 according to the first embodiment in that the division unit 61 calculates corrected light transmittances from light transmittances of R, G, B of each pixel which were calculated in the gamma converting unit 3 and the luminance distribution of the backlight which was calculated in the luminance distribution calculating unit 47.

The division unit 61 according to the second embodiment calculates a corrected light transmittance by dividing the light transmittances of R, G, B of each pixel which were calculated in the gamma converting unit 31 by the value of the luminance distribution of the backlight which was calculated in the luminance distribution calculating unit 47. Incidentally, the division unit 61 may obtain a corrected light transmittance by referring to a lookup table which previously holds relations of values corresponding to input and output. The lookup may be stored in the division unit 61 in advance or stored in an external storage which can be accessed by the division unit 61.

Liquid Crystal Panel 46 and Liquid Crystal Controlling Unit 45

The liquid crystal panel 46 and the liquid crystal controlling unit 45 according to the second embodiment may have the same configuration as the liquid crystal panel 16 and the liquid crystal controlling unit 15 according to the first embodiment.

Effects of the Present Embodiment

According to the image display apparatus relevant to the present embodiment, it is possible to minimize lightness difference (an error) observed in the displayed image, and accordingly, it is possible to suppress subjective image deterioration to the minimum and make an image display with a wider dynamic range and lower consumption power than that of the image display apparatus according to the first embodiment.

What is claimed is:

1. An image display apparatus, comprising:

a backlight configured to emit light;

a liquid crystal panel configured to modulate light emitted from the backlight to display an image on display area;

an emission intensity calculating unit including an acquiring unit configured to acquire a maximum value and a minimum value of lightness of an target image signal, a center value calculating unit configured to calculate a first center value, the first center value being a half of a summed value of the maximum value and the minimum value, and an intensity calculating unit configured to calculate an intensity of the backlight such that a second center value of a lightness range being displayable on the display area substantially coincides with the first center value;

a backlight controlling unit configured to control emission of light by the backlight in accordance with the intensity of the backlight;

a signal correcting unit configured to correct the target image signal in accordance with the intensity of the backlight; and a liquid crystal controlling unit configured to control the liquid crystal panel based upon the corrected target image signal.

2. The apparatus according to claim 1, wherein the signal correcting unit corrects the target image signal by dividing luminance of the target image signal by emission luminance depending on the intensity of the backlight.

3. The apparatus according to claim 2, wherein the emission intensity calculating unit includes a low-pass filter which performs low-pass filtering on the target input signal, and the center value calculating unit calculates the first center value based on the target input signal after low-pass filtering.

4. The apparatus according to claim 2, wherein the emission intensity calculating unit includes a resolution converting unit configured to convert a spatial resolution of the target input signal to a lower resolution, and the center value calculating unit calculates the first center value based on the target input signal after resolution conversion.

5. The apparatus according to claim 1, wherein the intensity calculating unit multiplies the first center value by a predetermined constant number to obtain the intensity of the backlight.

6. The apparatus according to claim 5, wherein the predetermined constant number is calculated based on a dynamic range of the liquid crystal panel.

7. The apparatus according to claim 1, wherein the backlight includes a plurality of light sources each of which are individually controllable with respect to intensity of each of the light sources, and the emission intensity calculating unit calculates the intensity of each of the light sources based on each corresponding signal of the target input signal within a spatial range depending on an irradiation range by each of the light sources to the liquid crystal panel.

* * * * *